US006659087B1

(12) United States Patent
Reddy

(10) Patent No.: US 6,659,087 B1
(45) Date of Patent: Dec. 9, 2003

(54) DETECTION OF EVAP PURGE HYDROCARBON CONCENTRATION

(75) Inventor: Sam R. Reddy, West Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/390,205

(22) Filed: Mar. 17, 2003

(51) Int. Cl.[7] ..... F02M 37/04

(52) U.S. Cl. ..... 123/520; 123/357; 123/494; 73/196; 73/861.04

(58) Field of Search ..... 123/520, 519, 123/518, 516, 521, 198 D, 357, 494, 698; 73/119 A, 118.2, 196, 861.01, 861.04

(56) References Cited

U.S. PATENT DOCUMENTS 5,249,561 A * 10/1993 Thompson ..... 123/520
5,373,822 A * 12/1994 Thompson ..... 123/520
5,560,347 A 10/1996 Reddy et al.
5,785,033 A * 7/1998 Kawamoto et al. ..... 123/520
5,921,226 A * 7/1999 Toyohara et al. ..... 123/674
6,098,601 A 8/2000 Reddy
6,119,662 A * 9/2000 Duty et al. ..... 123/520
6,234,156 B1 * 5/2001 Muto ..... 123/698
6,321,735 B2 * 11/2001 Grieve et al. ..... 123/698
6,374,812 B1 * 4/2002 Wiese ..... 123/520
6,446,618 B1 * 9/2002 Hill ..... 123/698
6,523,531 B1 * 2/2003 Feldkamp et al. ..... 123/698

OTHER PUBLICATIONS

Sultan, Myrna C. et al., Closed Loop Canister Purge Control System, (Feb. 1998), SAE Technical Paper Series, pp. 1–8.

* cited by examiner

*Primary Examiner*—Carl S. Miller
(74) *Attorney, Agent, or Firm*—Kathryn A. Marra

(57) ABSTRACT

In a system and a method for purging a vapor storage canister having adsorbed fuel vapor (or hydrocarbon vapor) by drawing air through the storage canister the storage canister being coupled with an engine having a system for controlling the amount of fuel provided to the engine, the amount of fuel vapor in the purge is determined by subtracting from a known total flow rate of air and vapor from the canister a measured air flow rate of air into the canister. The total flow rate of air and vapor from the canister may be obtained, for example, by knowing the intake manifold vacuum, by using a pump at a given flow rate capacity to draw the air and vapor through the canister, or by using a valve having a given flow rate that limits the flow rate of the air and vapor mixture drawn from the canister. An ECM or PCM can use the information of fuel vapor flow from the canister obtained in this way for better fuel control.

15 Claims, 3 Drawing Sheets

DETECTION OF EVAP PURGE HYDROCARBON CONCENTRATION

FIELD OF THE INVENTION

The present invention relates generally to systems and methods connected with vapor storage canisters. In particular, the present invention concerns drawing adsorbed hydrocarbon vapor from a storage canister for use in an internal combustion engine.

BACKGROUND OF THE INVENTION

The automotive industry has actively sought improved emissions reduction, including reduction in emissions due to gasoline evaporation. Gasoline includes a mixture of hydrocarbons ranging from higher volatility butanes ($C_4$) to lower volatility $C_8$ to $C_{10}$ hydrocarbons. When vapor pressure increases in the fuel tank due to conditions such as higher ambient temperature or displacement of vapor during filling of the tank, fuel vapor flows through openings in the fuel tank. To prevent fuel vapor loss into the atmosphere, the fuel tank is vented into a canister that contains an adsorbent material such as activated carbon granules.

As the fuel vapor enters an inlet of the canister, the fuel vapor diffuses into the carbon granules and is temporarily adsorbed. The size of the canister and the volume of the adsorbent material are selected to accommodate the expected fuel vapor evaporation. After the engine is started, the control system uses engine intake vacuum to draw air through the adsorbent to desorb the fuel. An engine control system may use an engine control module (ECM), a powertrain control module (PCM), or other such controller to optimize fuel efficiency and minimize emissions. The desorbed fuel vapor is directed into an air induction system of the engine as a secondary air/fuel mixture to consume the desorbed fuel vapor. One exemplary evaporative control system is described in U.S. Pat. No. 6,279,548 to Reddy, which is hereby incorporated by reference.

The amount of adsorbed fuel vapor in the canister will vary, so the amount of fuel vapor available to be drawn from the canister cannot be predicted. Further, the rate at which fuel vapor is drawn from the canister will decrease as more and more is removed until finally all of the fuel will have been desorbed from the canister. It would be desirable to enable the engine or powertrain control module to take into account the amount of fuel vapor drawn from the storage container in optimizing fuel efficiency and minimizing emissions and to be able to adjust for the decrease in fuel vapor from the storage canister as the adsorbed fuel is depleted.

One way to provide to the controller the information of fuel vapor drawn from the storage container might be to control the flow of vapors from the canister into the engine during purging based on information from an exhaust gas oxygen sensor. But a more direct, and possibly more accurate, approach would be to measure directly the amount of hydrocarbon being drawn from the storage canister during purging so that the engine controller can reduce the fuel from the fuel tank injected into the engine accordingly.

It would thus be useful to have a sensor that could measure the amount of hydrocarbon in the air drawn through the canister into the engine for better engine fuel control. The fuel vapor/air mixture exiting the canister will in general have a concentration of fuel (referred to herein also as "hydrocarbon") vapor that will initially vary depending upon the degree of adsorbent saturation and will decrease as more hydrocarbon vapor is drawn from the canister. Such a sensor could also be used to allow purging of the canister only while there is vapor to be withdrawn from the canister by detecting when the concentration of hydrocarbon vapor becomes zero. Presently, however, no cost-effective hydrocarbon sensors suitable for use in automotive vehicle vapor control systems have been developed. Thus, it would be desirable to be able to monitor the amount of hydrocarbon in the purge air using presently available sensors.

SUMMARY OF THE INVENTION

The present invention provides a method and an apparatus for detecting the concentration of hydrocarbon vapor in purge air drawn from a fuel vapor adsorbent canister or other fuel vapor storage canister, such as would be useful for preventing release of fuel vapors during fueling or for engine cold start with vapor, into the engine of an automotive vehicle. The canister contains adsorbent material capable of adsorbing fuel vapor from a fuel tank storing a volatile fuel. The canister includes a vapor inlet coupled to the fuel tank or a canister that generates fuel vapor, a purge outlet coupled to an air induction system of an engine, and an air inlet having a purge valve. The air induction system draws air from the canister at a given flow rate. Desorbed hydrocarbon vapor enters the air as it is drawn through the canister. The flow rate of the vapor/air mixture drawn into the engine, or "maximum flow rate," may be governed by a valve with a given maximum flow rate that is located between the vapor canister and the engine. Alternatively, the maximum flow rate may be governed by a pump with a given pump capacity located between the canister and the engine or by a known maximum flow rate due to manifold vacuum generated by the engine. The air inlet further includes a mass flow sensor that measures the air flow rate through the air inlet. The sensor provides the measured value for the air flow rate through the air inlet to an electronic engine controller. The controller approximates the flow rate of hydrocarbon in the air drawn from the canister according to the formula:

$$\text{hydrocarbon flow rate leaving canister} = \text{maximum flow rate} - \text{air flow rate through air inlet}$$

The controller can then use the value for the approximate hydrocarbon flow rate calculated from the air flow detected by the mass air flow sensor to make adjustments for engine fuel control or to end purging of the canister when no further vapor (or essentially no vapor) is being drawn from the canister.

The invention further provides a method for purging a vapor storage canister having adsorbed fuel (or hydrocarbon) coupled with an engine having a system for controlling the amount of fuel provided to the engine, e.g. an electronic engine control module. In the method, the amount of fuel vapor in the purge is determined by drawing with a pump or intake manifold vacuum a known total flow rate of air and vapor from the canister; using a mass air flow sensor at the air inlet to determine the flow rate of air into the canister; and subtracting the flow rate of air from the total flow rate to obtain the flow rate of fuel vapor in the fuel/air mixture the pump or manifold vacuum draws from the canister. The known total flow rate of air and vapor drawn from the canister may be obtained, for example, by either using a known manifold vacuum or a pump at a given flow rate capacity to draw the air and vapor through the canister or by using a valve having a given flow rate that limits the flow rate at which the intake manifold vacuum or pump would otherwise draw the air and vapor mixture through the canister. An ECM or PCM can use the information of fuel vapor flow from the canister obtained in this way to improve fuel efficiency. The amount of fuel drawn from the fuel tank can be reduced by the known amount of fuel vapor in the purge.

In another embodiment, the amount of fuel vapor determined to be in the purge gas is monitored so that when the amount drops to a desired amount (for example, when essentially no more hydrocarbon vapor is in the purge), the purge is ended.

In still a further embodiment, the purge gasoline vapor is used for engine cold start and the controller determines the amount of fuel vapor in the purge to use in controlling engine conditions. This process uses a vapor cold start system having a canister containing activated carbon, which adsorbs hydrocarbon vapor to become a charged canister, a system for generating the hydrocarbon vapor to charge the canister, the canister being connected between an air inlet and the intake manifold. A mass air flow sensor is located between the canister and the intake manifold. The mass air flow sensor provides input to an ECM or PCM, which uses the information of fuel vapor flow from the canister to determine whether and how much fuel to draw from the fuel tank and/or when the canister must be re-charged.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
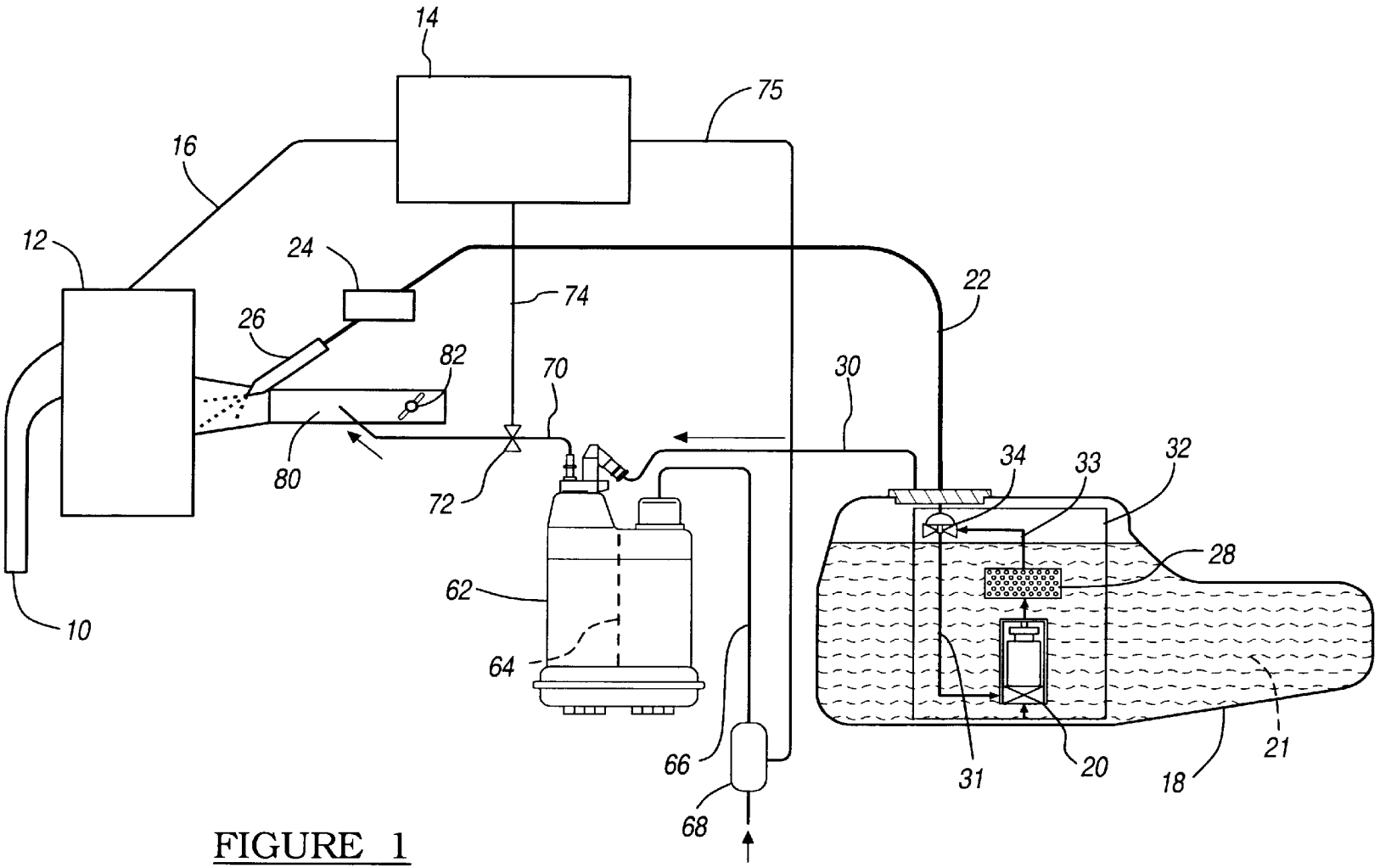
FIG. 1 is a functional block diagram of an engine and evaporative control system for a vehicle.

Referring now to FIG. 1, an engine 12 having an intake manifold 80 and exhaust manifold 10 is illustrated. The vehicle may be a conventional (non-hybrid) vehicle including an internal combustion engine or a hybrid vehicle including an internal combustion engine and an electric motor (not shown). The engine 12 is preferably an internal combustion engine that is controlled by a controller 14. The engine 12 typically burns gasoline, ethanol, and other volatile hydrocarbon-based fuels. The controller 14 may be a separate controller or may form part of an engine control module (ECM), a powertrain control module (PCM), or another vehicle controller.

When the engine 12 is started, the controller 14 receives signals from one or more engine sensors, transmission control devices, and/or emissions control devices. Line 16 from the engine 12 to the controller 14 schematically depicts the flow of sensor signals. During engine operation, gasoline 21 is delivered from a fuel tank 18 by a fuel pump 20 through a filter 28 and fuel lines 33 and 22 to a fuel rail (not shown). Fuel injectors inject gasoline into cylinders of the engine 12 or to ports that supply groups of cylinders. FIG. 1 shows one such fuel injector 26. The timing and operation of the fuel injectors and the amount of fuel injected are managed by the fuel controller 24. Fuel controller 24 is controlled by controller 14.

The fuel tank 18 is often made of blow-molded, high-density polyethylene provided with one or more gasoline impermeable interior layer(s). The fuel tank contains a fuel sender module 32. Fuel pump 20 pumps gasoline 21 through filter 28 and fuel line 33 to pressure regulator 34, where the unused fuel is returned to the tank. By-pass line 31 returns unused gasoline to the fuel pump inlet.

The fuel tank 18 includes a vent line 30 that extends from the fuel tank 18 to a fuel vapor adsorbent canister 62. Fuel vapor pressure increases as the temperature of the gasoline increases. Vapor flows under pressure through the vent line 30 to the fuel vapor adsorbent canister 62. The vapor enters the canister 62 and is captured by suitable adsorbent material (not shown), such as activated carbon materials, on either side of a center wall 64. The fuel vapor adsorbent canister 62 is formed of any suitable material. For example, molded thermoplastic polymers such as nylon are typically used. After the fuel vapor is adsorbed in the canister, the air exits through vent line 66.

Vent line 66 provides air during purging of adsorbed fuel vapor from the canister 62. A stream of purge air and fuel vapor exit the canister through the purge line 70. Vent line 66 contains air flow sensor 68, which may be located at any point along vent line 66, including at either end. Air flow sensor 68 provides an air flow rate signal line 75 to the controller 14. The purge line 70 contains valve 72 that selectively closes the canister 62 off from engine 12. Purge valve 72 is operated by the controller 14 through a signal lead 74 when the engine 12 is running. Purge valve 72 is closed when vapor flows through vent line 30 to be adsorbed in canister 62, but is opened when the adsorbed vapor is being purged from the canister when the engine is operating. The air becomes laden with desorbed hydrocarbon fuel vapor desorbed from canister 62. The fuel-laden air is drawn through the purge line 70.

In one embodiment, purge valve 72 limits the flow rate through purge line 70 and allows a known flow rate of the fuel-laden air. Controller 14 uses the known flow rate of valve 72, along with the air flow sensor signal 75, to determine the rate of hydrocarbon vapor flow through purge valve 72. The flow rate allowed by purge valve 72 in this case is lower than the flow rate that would result from removing the purge valve 72, so that the purge valve 72 determines the flow rate through purge line 70 into engine 12. The sum of the air flow rate through air sensor 68 and the hydrocarbon flow rate from the canister 62 is approximately equal to the known flow rate of purge valve 72.

The controller approximates the flow rate of hydrocarbon in the air drawn from the canister according to the formula:

$$\text{hydrocarbon flow rate leaving canister} = \text{flow rate of purge valve} - \text{air flow rate through air inlet}$$

For example, when the purge valve limits flow rate to 11.2 L/min, if the mass flow sensor detects a flow rate of 3.5 L/min air passing through the air inlet, then the hydrocarbon flow rate from the canister is 7.7 L/min.

When the adsorbent is saturated or nearly saturated, the hydrocarbon concentration in the purge vapor is at its highest and the flow rate of air into the air inlet is at its lowest. As more hydrocarbon is purged from the canister, more air flows through the inlet to meet the flow rate capacity. In another example, when the air flow sensor measures a flow rate of air passing into the air inlet that is equal to the purge valve flow rate, then the hydrocarbon flow rate is zero; the adsorbent in the canister has been fully purged, and the purge valve may be closed.

Determining the hydrocarbon flow rate by this method gives the controller information that can be used for improved engine fuel control. The hydrocarbon flow rate can also be used for smart control of EVAP canister purging, by allowing the controller to determine when purging (or further purging) is unnecessary. Purging after little or no hydrocarbon remains adsorbed in the canister can increase problems of contamination of the canister contents and deterioration by dirt and/or moisture. Because the purge valve flow rate may be affected by the ambient temperature, battery voltage, and manifold vacuum (if the manifold vacuum is less than 30 kPa), the controller may apply correction factors to the determined purge fuel flow rate to take these conditions into account. Such correction factors are similarly used by the controller for engine purge calibration, which is well known.

Figure 2:
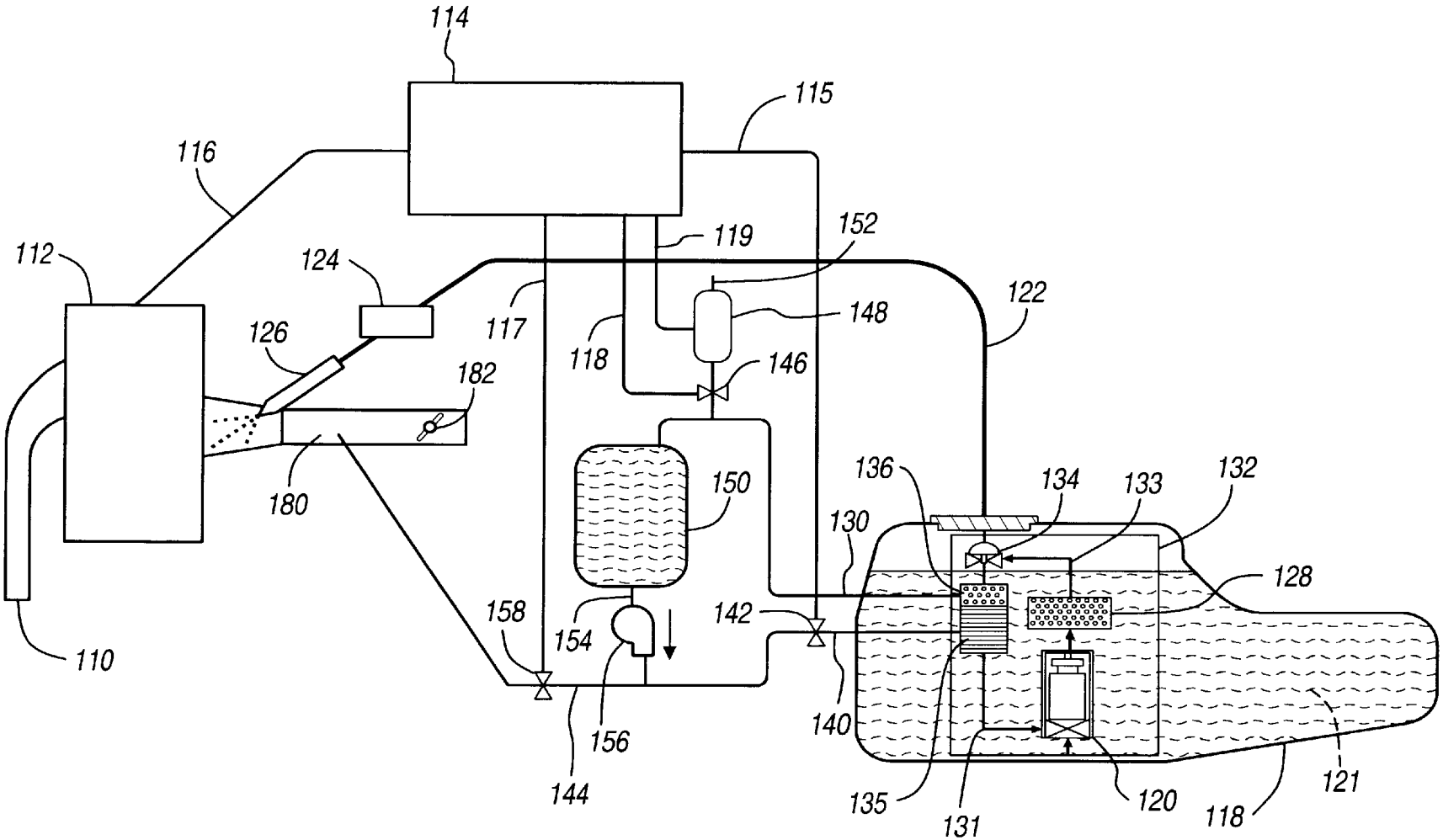
FIG. 2 is a functional block diagram of an engine for a vehicle containing a cold start canister.

In yet another embodiment shown in FIG. 2, a method for engine cold start with vapor is carried out by drawing into the engine vapor from a cold start vapor storage canister. In this embodiment, engine 112 is controlled by a controller 114. Controller 114 may be a separate controller or may form part of an engine control module (ECM), a powertrain control module (PCM), or another vehicle controller. Line 116 represents a flow of signals from engine sensors and other sensors to the controller 114 and from the controller 114 to the engine 112. Fuel tank 118 contains fuel sender module 132. Gasoline 121 is delivered from a fuel tank 118 by a fuel pump 120 through a filter 128 and fuel lines 133 and 122 to a fuel rail (not shown). Pressure regulator 134 returns unused fuel via by-pass line 131. Fuel injectors inject gasoline into cylinders of the engine 112 or to ports that supply groups of cylinders. FIG. 2 shows one such fuel injector 126. The timing and operation of the fuel injectors and the amount of fuel injected are managed by the fuel controller 124. Engine exhaust exits from exhaust manifold 110.

During engine operation, fuel vapor is created and stored in cold start canister 150. Vapor is produced in vapor generator 135 located in by-pass line 131 by bubbling air through liquid gasoline 135. Gasoline drains from the bottom of vapor generator 135 and is returned to the fuel tank. The vapor that collects in headspace 136 is drawn off through line 130 into cold start canister 150 by operation of pump 156. The fuel vapor is adsorbed in canister 150 by a suitable adsorbent, such as an activated carbon material. During collection of fuel vapor in canister 150, valves 146 and 158 are closed and valve 142 is open. The valves, which may be for example solenoid valves, are actuated by controller 114 through signal lines 115, 117, and 118. Pump 156 draws fuel-laden air from headspace 136 through line 130 to cold start canister 150, where the fuel vapor in the air is adsorbed. The air is returned through line 154, pump 156 in line 154, and return line 140 to vapor generator 135. The return air preferably enters vapor generator 135 underneath the surface of collected gasoline to aid in generating fuel vapor in headspace 136. When the cold start canister 150 has adsorbed a desired amount of fuel vapor, pump 156 is stopped and valve 142 is closed.

During cold start of the engine, air is pumped through the cold start canister 150 to produce fuel/air mixture. Starting a cold engine with vapor reduces unburned hydrocarbon emissions. For engine cold start, valve 142 is closed and valves 158 and 146 are open by controller 114 through signal lines 115, 117, and 118. Air enters through vent line 152 and valve 146 in vent line 152. An air flow sensor 148 is also located in vent line 152. Pump 156 draws the air through the cold start canister 150, desorbing fuel vapor from the adsorbent material. The air/fuel mixture is pumped through purge line 144, through valve 158, and into intake manifold 180 of engine 112.

Air flow sensor 148 provides an air flow rate signal line 119 to the controller 114. Valve 158 in purge line 144 limits the flow rate through purge line 144 and allows a known flow rate of the fuel-laden air into engine 112. Controller 114 uses the known flow rate of valve 158, along with the air flow sensor signal 119 measuring the intake of air into the cold start canister 150, to determine the rate of hydrocarbon vapor flow into engine 112. The sum of the air flow rate through air sensor 148 and the hydrocarbon flow rate from the canister 150 is approximately equal to the known flow rate of purge valve 158. In another embodiment, the maximum flow rate is limited by pump capacity of pump 156 instead of by the flow rate through purge valve 158. In this case, the sum of the air flow rate through air sensor 148 and the hydrocarbon flow rate from the canister 150 is approximately equal to the known pump capacity of pump 156. In another design, valve 158 is open completely and pump 156 voltage is regulated to control the cold start vapor/air mixture flow rate.

Controller 114 approximates the flow rate of hydrocarbon in the air drawn from the canister according to the formula:

hydrocarbon flow rate leaving canister=flow rate of purge valve−air flow rate through air sensor (or pumping capacity of pump−air flow rate through air sensor)

For example, when the pump pumps at a rate of 11.2 L/min or when the purge valve limits flow rate to 11.2 L/min, if the air mass flow sensor detects a flow rate of 3.5 L/min air passing through the air inlet, then the hydrocarbon flow rate from the canister is 7.7 L/min.

Figure 3:
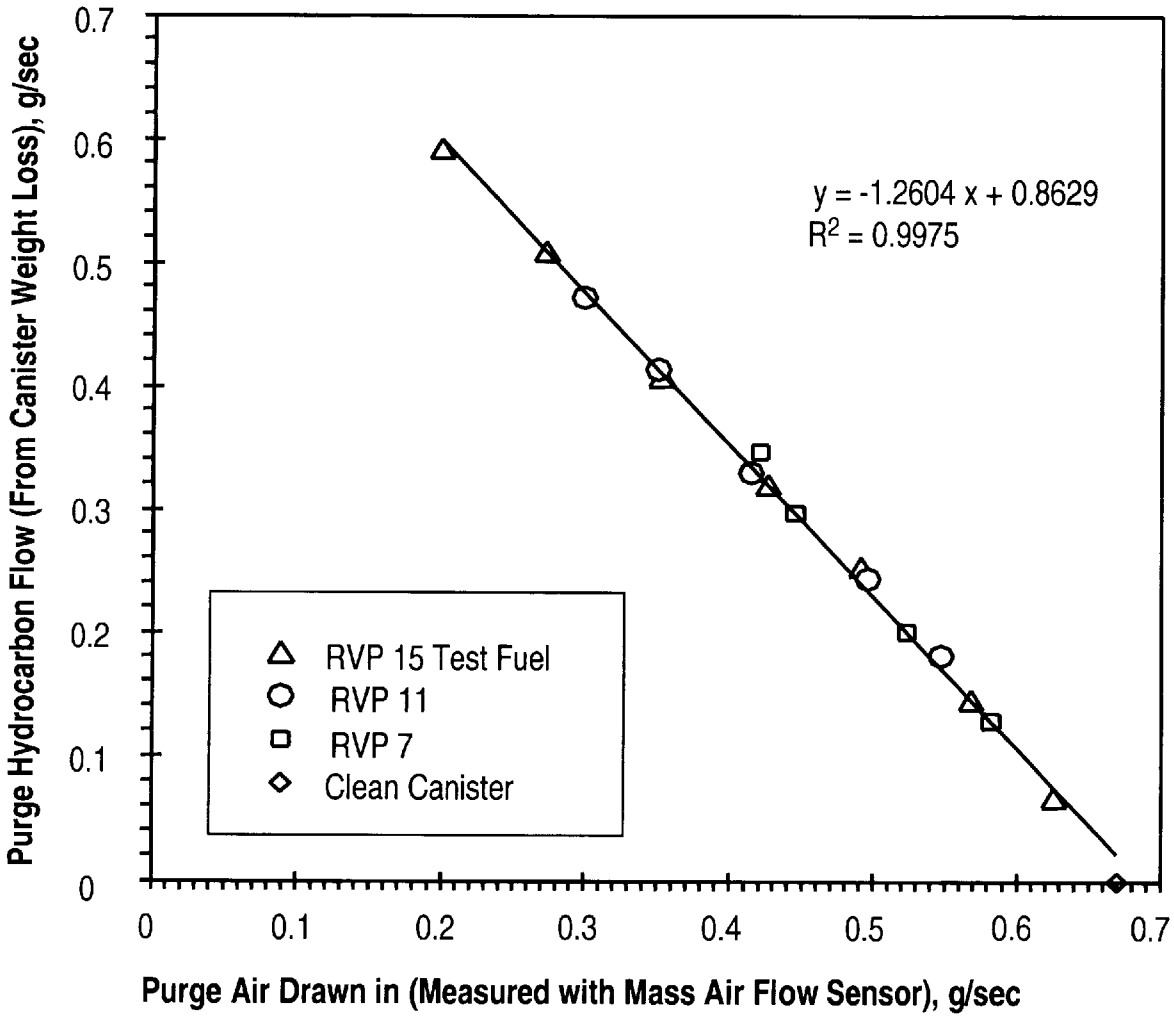
FIG. 3 is a graph showing correlation between measured purge hydrocarbon flow determined by the invention compared to measured purge hydrocarbon flow determined by weight loss.

Canister purge tests were conducted using canisters loaded with various amounts of gasoline vapor generated from different RVP fuels. FIG. 3 shows an excellent correlation between purge air flow into the canister and purge hydrocarbon flow out of the canister for the different fuels tested. Thus, a mass or volume air flow sensor can be used to detect hydrocarbon concentration in cold start vapor from a cold start canister or in purge vapor from an EVAP canister.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of operating a vehicle having an internal combustion engine with an air induction system, a fuel tank connected to the engine to supply fuel to the engine, an electronic engine control module comprising a programmed microprocessor controlling fuel delivery to the engine, and a canister to adsorb vapor from the fuel tank comprising a vapor inlet coupled to the fuel tank, a purge outlet coupled to the air induction system, and an air inlet having a mass flow meter and a purge valve operable by a signal from the electronic engine control module, comprising steps of:

adsorbing fuel vapor from the fuel tank into the canister through the vapor inlet;

desorbing fuel vapor from the canister through the purge outlet by opening the purge valve through a signal from the electronic engine control module and drawing air through the canister into the air induction system;

measuring the air flow rate at the air inlet with a mass flow sensor that provides a value of the air flow rate to the electronic engine control module;

calculating in the electronic engine control module an approximate hydrocarbon flow rate from the canister by subtracting the value of the air flow rate at the air inlet from a known value for maximum flow rate from the canister;

using the electronic engine control module to adjust fuel delivery from the fuel tank to the engine in response to the calculated approximate hydrocarbon flow rate.

2. A method according to claim 1, wherein the maximum flow rate from the canister is determined by an intake manifold vacuum of the air induction system.

3. A method according to claim 1, wherein the maximum flow rate from the canister is determined by the flow rate of a valve located between the canister and the induction system.

4. A method according to claim 1, wherein the maximum flow rate from the canister is determined by a pump capacity of a pump located between the canister and the induction system.

5. A method according to claim 1, further comprising a step of closing the purge valve through a signal from the electronic engine control module when the calculated approximate hydrocarbon flow rate is approximately zero.

6. A method according to claim 1, wherein the hydrocarbon vapor drawn from the canister is used for engine cold start.

7. An apparatus for determining the concentration of hydrocarbon vapor in purge air drawn from a canister containing adsorbed hydrocarbon vapor, comprising the canister containing adsorbed hydrocarbon vapor, said canister comprising a vapor inlet coupled to a source of hydrocarbon vapor, a purge outlet having a given maximum flow rate, and an air inlet having a mass flow meter for measuring air flow into the canister, and a microprocessor programmed to determine concentration of hydrocarbon vapor in purge air drawn from the canister by subtracting the air flow into the canister from the maximum flow rate.

8. A vehicle having an internal combustion engine with an air induction system, a fuel tank connected to the engine to supply fuel to the engine, an electronic engine control module comprising a programmed microprocessor controlling fuel delivery to the engine, and a canister to adsorb vapor from the fuel tank comprising a vapor inlet coupled to the fuel tank, a purge outlet coupled to the air induction system, and an air inlet having a mass flow meter and a purge valve operable by a signal from the electronic engine control module, wherein the microprocessor is programmed to determine concentration of hydrocarbon vapor in purge air drawn from the canister by subtracting the air flow into the canister from a maximum flow rate from the purge outlet to the air induction system.

9. A vehicle according to claim 8, wherein the maximum flow rate is determined by a valve having a maximum flow rate, said valve being located between the purge outlet and the air induction system.

10. A vehicle according to claim 8, wherein the maximum flow rate is determine by manifold vacuum of the engine.

11. A vehicle according to claim 8, wherein the fuel tank is coupled with a vapor generator that produces fuel vapor from fuel in the fuel tank and to a pump for drawing the fuel vapor from the vapor generator into the canister.

12. A method for determining the hydrocarbon vapor in purge air drawn from a canister containing adsorbed hydrocarbon vapor, comprising the steps of:

drawing air into the canister containing adsorbed hydrocarbon vapor and withdrawing from the canister the air and desorbed hydrocarbon vapor, wherein the air and desorbed hydrocarbon vapor are withdrawn at a maximum flow rate;

measuring the mass flow rate of the air into the canister;

determining the hydrocarbon flow rate leaving the canister by subtracting the mass flow rate of air into the canister from the maximum flow rate.

13. A method according to claim 12, wherein the maximum flow rate is the flow rate of valve through which the air and desorbed hydrocarbon vapor pass.

14. A method according to claim 12, wherein the air is drawn through the canister by a pump and further wherein the maximum flow rate is the pump capacity.

15. A method according to claim 12, wherein the air is drawn through the canister by an air induction system of an internal combustion engine.

* * * * *